US005436608A

United States Patent [19]

Togura

[11] Patent Number: 5,436,608

[45] Date of Patent: Jul. 25, 1995

[54] SURGE ABSORBER

[75] Inventor: Jiro Togura, Odawara, Japan

[73] Assignee: Patent Promote Center Ltd., Hiratuka, Japan

[21] Appl. No.: 139,008

[22] Filed: Oct. 21, 1993

[30] Foreign Application Priority Data

Apr. 3, 1993 [JP] Japan ..... 5-100295

[51] Int. Cl.[6] ..... H01C 7/10

[52] U.S. Cl. ..... 338/21; 361/117

[58] Field of Search ..... 338/20, 21, 203, 227; 361/117, 118, 120, 129, 130; 337/31, 15, 163

[56] References Cited

U.S. PATENT DOCUMENTS 4,317,155 2/1982 Harada et al. ..... 361/120
4,434,416 2/1984 Schonberger ..... 338/195 X
4,727,350 2/1988 Ohkubo ..... 338/21
4,924,205 5/1990 Caporali et al. ..... 338/227
5,184,273 2/1993 Tanaka et al. ..... 361/120

*Primary Examiner*—Marvin M. Lateef
*Attorney, Agent, or Firm*—Wenderoth, Lind & Ponack

[57] ABSTRACT

The surface of conductive silicon plate is scored with a grid of score lines, such that a plurality of small rectangular protrusions are formed. An insulating film is formed on the exposed surfaces of the rectangular protrusions. The conductive silicon plate is sliced through from the middle portion of each of the score lines to produce conductive silicon chips. The height of the rectangular protrusion defines a micro gap. The conductive silicon chip and two opposed electrodes contacted thereto are mounted in a glass tube having a reduced pressure therein.

4 Claims, 1 Drawing Sheet

SURGE ABSORBER

BACKGROUND OF THE INVENTION

1. Field of the Invention

The present invention relates to a gap type discharge absorbing element to protect electric devices and circuits from overvoltage and in particular a conductive chip having an insulating gap is adopted as a spacer.

2. Description of the Related Art

Although a discharge tube glass-sealed with two opposed electrodes retained with a prescribed space therebetween is inexpensive to manufacture, the discharge lag and electrode wear are substantial. A gap type surge absorbing element has been considered, in which an insulating spacer of 50 to 100 μm intervenes between opposed electrodes, a creeping discharge (primary discharge) is first initiated along the surface of the insulating gap, and next an arc discharge (secondary discharge) is induced between the opposed electrodes. The problem of discharge lag is not present with the two-stage discharge type. However, this type of surge absorbing element has not prevailed because of an imbalance of the discharge characteristics due to fluctuations and/or changes in materials and the shapes of the electrodes and thickness of the spacer. As a gap type surge absorbing element, the opposed electrodes are attached at both ends of a ceramic tube of which the outer circumferential surface is coated with a conductive plate, the middle of the plate is cut off by a laser beam to engrave micro gaps (50 to 100 μm) and the conductive plate is divided into two (U.S. Pat. Nos. 4,317,155 and 4,727,350).

In a surge absorbing element in which micro gaps are formed by a laser beam, the opposed conductive plate edges having the micro gap therebetween appear with serrations when observed in enlargement. The serrations result in the discharge initiation voltage between the plates being unstable. Precision is required in technology for slicing a ceramic tube with a micro gap, thereby leading to high manufacturing costs. A surge absorbing element which is inexpensive in cost and has superior discharge characteristics has been strongly demanded in line with diffusion of electronic circuits in a wide range. The present invention has been developed in response to this demand.

SUMMARY OF THE INVENTION

Gap grooves (or score lines) of a prescribed depth are longitudinally and transversely formed on the surface of a conductive plate by scoring with a rotary blade, thereby causing a grid of rectangular parallelepiped protrusions to be formed in a checkered pattern, such that the height of the rectangular parallelepiped protrusion constitutes a discharge gap. Then, the conductive wafer is sliced through from each of the respective longitudinal and transverse score lines by using a narrower rotary blade to form a number of rectangular chips. Two Dumet wires are brought into contact with the insulating film side and an opposing side of one of the rectangular chips to constitute opposing electrodes, and the chip and wires are inserted in a glass tube into which inert gas such as argon gas is supplied with the pressure thereof reduced, thereby causing the glass tube to be sealed.

DESCRIPTION OF THE PREFERRED EMBODIMENTS

Figure 3:
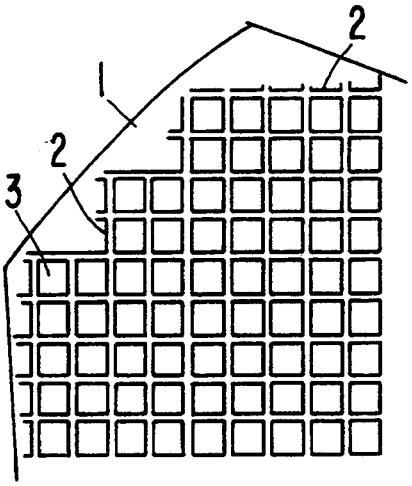
FIG. 3 is a diagrammatical view showing longitudinal and transverse gap grooves on the surface of a conductive plate.

Gap grooves (or score lines) 2 of a prescribed depth are longitudinally and transversely formed (scored) by a rotary blade on the surface of a conductive silicon plate (wafer) 1 of which the volume resistivity is 40 Ω.cm, thereby causing protrusions 3 of a rectangular parallelepiped to be formed in a checkered pattern (or a grid) (FIG. 3). The bottom of the longitudinal and transverse score lines are uniformly horizontal, and the depth thereof is the height of the protrusions 3 of a rectangular parallelepiped. The thickness of the conductive silicon wafer 1 is 270 μm, the width of the score lines 2 is 60 μm, the depth thereof is 50 μm, and the space between parallel adjacent score lines is 480 μm. It is possible to accurately set the depth of the longitudinal and transverse score lines 2 with a precise rotary blade controller. The present invention features the fact that the bottoms of the adjacent score lines 2 are on the same level.

A 0.5 to 3 μm thick insulating film 4 is formed on the surface at the side of the protrusions 3 of rectangular parallelepiped of the conductive silicon wafer 1 by a CVD method (chemical film formation method), a forced oxidization method, etc. The surface of the rectangular parallelepiped protrusions 3 and score lines 2 will be coated with the insulating film 4.

Figure 4:
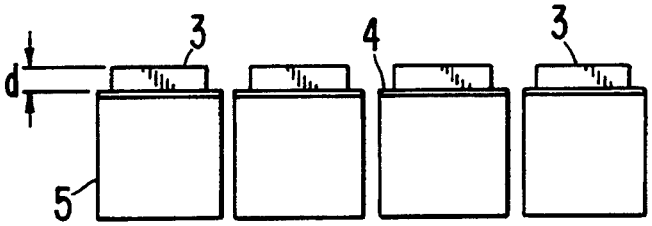
FIG. 4 is a front elevational view of a conductive chip when the conductive plate is sliced along the gap grooves.

Cuts are made at the middle portions of the longitudinal and transverse score lines 2 by using a thinner rotary blade in order to secure a number of conductive silicon chips 5 each having a base portion and a protrusion (or head) portion (see FIG. 4). Parts of the bottoms of the score lines 2 may be left over at the head portions of conductive silicon chips 5 as a staged (or shoulder) portion. The circumferential staged portions (or shoulder portions) of the rectangular parallelepiped protrusions 3 are placed on a uniformly flat horizontal plane. The distance (d) from the stage portion to the top of the rectangular parallelepiped protrusion 3 is a micro gap.

A conductive silicon chip 5 is horizontally laid in a glass tube 6 of which the inner diameter is 860 μm. A pair of Dumet wires 7 are brought into engagement with opposing ends of the conductive silicon chip 5 (i.e. with the rectangular parallelepiped protrusion 3 and the bottom of the conductive silicon chip 5) so as to constitute opposing electrodes. The outer diameter of the Dumet wire 7 is roughly equal to the inner diameter of the glass tube 6. In the state shown in FIG. 1, glass sealing is effected to form a vacuum chamber in which a temperature is high and inert gas such as argon gas is kept at 0.3 atm pressure.

In order to make the primary discharge possible, it is preferable that the conductive silicon chip 5 has a resistance value of 0.01 to 1,000 Ω.cm. The depth of the score line 2 is proportionate to the discharge initiation voltage of a surge absorbing element and is set to 25 to 100 μm. In a conventional micro gap forming means using laser beams, it was technically impossible to produce micro gaps of less than 50 μm. As with the present invention it is possible to very accurately control the adjustment of the depth of score lines 2 by a rotary blade, even micro gaps of less than 25 μm can be produced. A wafer of, for example, gallium arsenide, rather than a silicon plate, is acceptable if it has conductivity of 0.01 to 1,000 Ω.cm.

Figure 2:
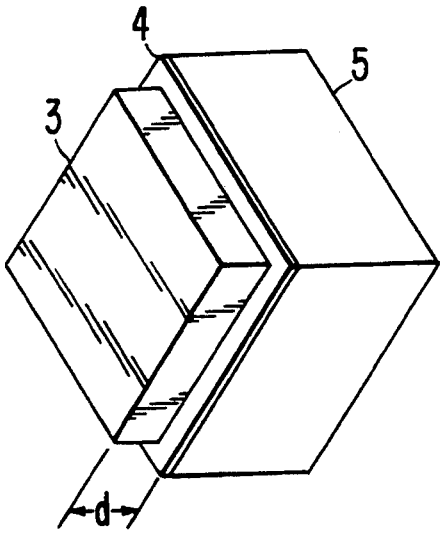
FIG. 2 is a perspective view of the head of a conductive chip which is coated with an insulating film.

It is possible to control the depth d (corresponding to the width of a micro gap, about 50 μm) of the respective score lines 2 in units of μm. And as the surface of the rectangular parallelepiped protrusion and horizontal bottom of the score line 2 are coated with an insulating film 4 after formation of the gap grooves 2, the conductive silicon chip will appear, as shown in FIG. 2, as if wearing a hat having a horizontal flange. The flange having uniformly horizontal surfaces at the four corners of the hat causes the discharge gap space to be kept uniform at all times. The discharge characteristics will be stabilized.

Figure 1:
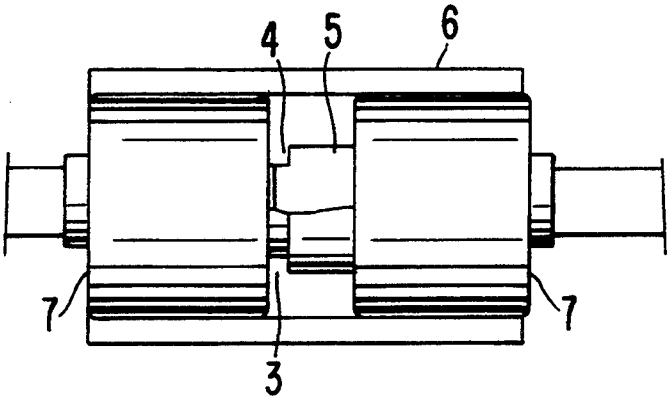
FIG. 1 is an elevation view of a surge absorber of the present invention.

In FIG. 1, as a surge voltage is impressed between the Dumet wires which are the opposed electrodes, the primary discharge is first initiated between the rectangular parallelepiped protrusion ends having a height of 50 μm. Next, the secondary discharge (arc discharge) is induced between the opposed electrodes. The discharge initiation voltage differs according to the kind and pressure of gas to be glass-sealed, resistivity of electrodes and conductive silicon chips. However, the discharge initiation voltage is 200 to 300 volts when the height of the rectangular parallelepiped protrusions, formed by the micro gaps, is 50 μm, 150 to 200 volts when it is 25 μm and 250 to 330 volts when it is 100 μm.

In another preferred embodiment, the opposed electrodes 7 may be attached onto the insulating film 4 of the conductive silicon chip 5, with a distance of 200 μm or so therebetween.

In summary, in the present invention, the head of a conductive silicon chip 5 is coated with an insulating film, and opposed electrodes are brought into contact with the head and bottom thereof, mounted in a glass tube in which a discharge gas like argon gas or the like is supplied with its pressure reduced, and glass sealed. Therefore, the height (d) of a rectangular parallelepiped protrusion at the head will be the depth of a micro gap, thereby causing a primary discharge to be generated, and continuously causing a secondary discharge to be induced between the opposed electrodes. Namely, the invention can provide a surge absorbing element, which is free from any discharge lag, at a cheap price. Furthermore, the height (d) of the rectangular parallelepiped protrusion 3 is the depth of the score lines, and all the longitudinal and transverse score lines are uniformly formed to cause all the score line bottoms to exist on the same level. Therefore, the gap (d) of all surge absorbing elements can be maintained at a set value.

I claim:

1. A micro gap type surge absorber, comprising:

a glass tube with a reduced-pressure inert gas filled therein;

a conductive chip mounted in said glass tube, said conductive chip having a base portion and a rectangular protrusion portion protruding from said base portion;

an insulating film coated on said rectangular protrusion portion of said conductive chip; and a first electrode attached to said rectangular protrusion portion of said conductive chip, and a second electrode attached to said base portion of said conductive chip, to thereby form a non-conductive micro gap between said first and second electrodes.

2. A micro gap type surge absorber as recited in claim 1, wherein said conductive chip includes a shoulder portion between said base portion and said rectangular protrusion portion, said shoulder portion being disposed all around a periphery of said rectangular protrusion portion.

3. A method of manufacturing a surge absorber, comprising the steps of:

scoring a conductive wafer with a grid of score lines so as to form a plurality of rectangular protrusions on said conductive wafer;

forming an insulating film on exposed surfaces of said rectangular protrusions;

cutting through said conductive wafer from a middle portion of each of said score lines to form a plurality of individual conductive chips, each of which includes one of said rectangular protrusions;

interposing one of said conductive chips between two electrodes in such a manner that one of said electrodes is in contact with said insulating film, to thereby form a non-conductive micro gap between said electrodes; and mounting said one of said conductive chips and said two electrodes in a sealed glass container having a reduced-pressure inert gas therein.

4. A method as recited in claim 3, wherein said step of scoring said conductive wafer is carried out with a first rotary blade; and said step of cutting through said conductive wafer is carried out with a second rotary blade thinner than said first rotary blade, such that each of said conductive chips is provided with a shoulder portion disposed all around a periphery of said rectangular protrusion.

* * * * *

UNITED STATES PATENT AND TRADEMARK OFFICE

CERTIFICATE OF CORRECTION

PATENT NO. : 5,436,608

DATED : July 25, 1995

INVENTOR(S) : Jiro Togura

It is certified that error appears in the above-indentified patent and that said Letters Patent is hereby corrected as shown below:

The title page, showing an illustrative figure, should be deleted and substitute therefor the attached title page.

Delete Figure 1 and substitute the attached Figure 1.

Signed and Sealed this

Nineteenth Day of March, 1996

Bruce Lehman

*Attest:*

BRUCE LEHMAN

*Attesting Officer*

*Commissioner of Patents and Trademarks*

United States Patent [19]

Togura

[11] Patent Number: 5,436,608

[45] Date of Patent: Jul. 25, 1995

[54] SURGE ABSORBER

[75] Inventor: Jiro Togura, Odawara, Japan

[73] Assignee: Patent Promote Center Ltd., Hiratuka, Japan

[21] Appl. No.: 139,008

[22] Filed: Oct. 21, 1993

[30] Foreign Application Priority Data

Apr. 3, 1993 [JP] Japan ..... 5-100295

[51] Int. Cl.[6] ..... H01C 7/10

[52] U.S. Cl. ..... 338/21; 361/117

[58] Field of Search ..... 338/20, 21, 203, 227; 361/117, 118, 120, 129, 130; 337/31, 15, 163

[56] References Cited

U.S. PATENT DOCUMENTS 4,317,155 2/1982 Harada et al. ..... 361/120
4,434,416 2/1984 Schonberger ..... 338/195 X
4,727,350 2/1988 Ohkubo ..... 338/21
4,924,205 5/1990 Caporali et al. ..... 338/227
5,184,273 2/1993 Tanaka et al. ..... 361/120

*Primary Examiner*—Marvin M. Lateef
*Attorney, Agent, or Firm*—Wenderoth, Lind & Ponack

[57] ABSTRACT

The surface of conductive silicon plate is scored with a grid of score lines, such that a plurality of small rectangular protrusions are formed. An insulating film is formed on the exposed surfaces of the rectangular protrusions. The conductive silicon plate is sliced through from the middle portion of each of the score lines to produce conductive silicon chips. The height of the rectangular protrusion defines a micro gap. The conductive silicon chip and two opposed electrodes contacted thereto are mounted in a glass tube having a reduced pressure therein.

4 Claims, 1 Drawing Sheet

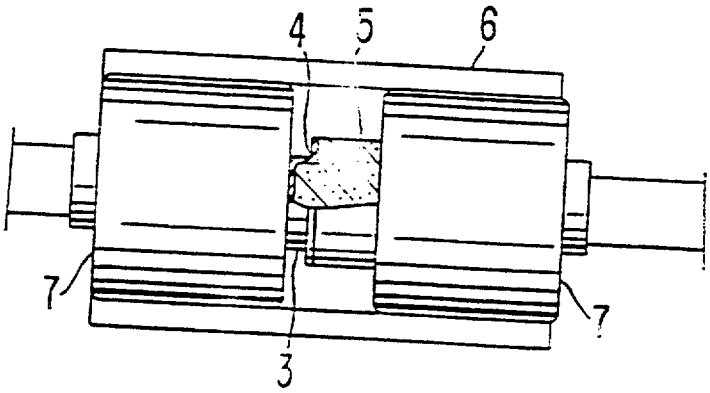

UNITED STATES PATENT AND TRADEMARK OFFICE

CERTIFICATE OF CORRECTION

PATENT NO. : 5,436,608

DATED : July 25, 1995

INVENTOR(S) : Jiro Togura

It is certified that error appears in the above-indentified patent and that said Letters Patent is hereby corrected as shown below:

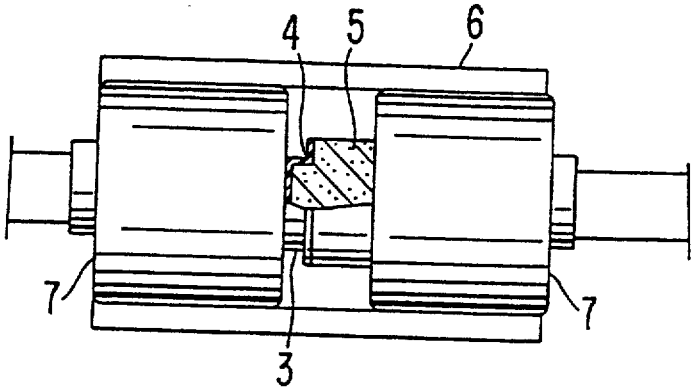

FIG. 1